US005427031A

United States Patent [19]

Bowman

[11] Patent Number: 5,427,031

[45] Date of Patent: Jun. 27, 1995

[54] DETONATOR PRIMER CAPSULE

[75] Inventor: Arthur F. Bowman, Tamaqua, Pa.

[73] Assignee: ICI Explosives USA Inc., Tamaqua, Pa.

[21] Appl. No.: 65,458

[22] Filed: May 20, 1993

[51] Int. Cl.[6] ..... F42B 3/00

[52] U.S. Cl. ..... 102/331; 102/202.12; 102/202.14

[58] Field of Search ..... 102/331, 202.12, 202.14

[56] References Cited

U.S. PATENT DOCUMENTS

| | | | |
|---|---|---|---|
| 3,248,504 | 4/1966 | McGirr et al. | 102/202.14 |
| 4,348,955 | 9/1982 | Rowley et al. | 102/331 X |
| 4,576,094 | 3/1986 | Meador | 102/202.14 X |
| 4,615,271 | 10/1986 | Hutchinson | 102/331 X |
| 4,625,645 | 12/1986 | Williams | 102/202.14 |
| 4,735,145 | 4/1988 | Johnson et al. | 102/202.14 |
| 5,313,887 | 5/1994 | Morris | 102/331 |

*Primary Examiner*—Peter A. Nelson
*Attorney, Agent, or Firm*—Charles Q. Buckwalter

[57] ABSTRACT

A detonator for detonation of explosives which provides protection of a primer charge from sympathetic initiation and provides efficient detonation of a base charge. The detonator is comprised of, a hollow detonator shell having first and second ends, said detonator shell has inserted therein a delay element and a primer capsule. Said delay element is positioned within the first end of the shell and has a core running therethrough. The primer capsule has a protective frustrum top having an opening centrally located therein and a tubular bottom. The primer capsule is inserted into the second end of the shell such that the core of the delay element is in contact with the opening in the frustrum top. The primer capsule top contains a primer charge and the bottom contains primer charge and a small amount of base charge material. The top is constructed with heavy walls such that the primer charge is protected. Further, the top is constructed such that upon initiation of the primer charge by the delay element the output of the primer charge is focused toward the base charge material which when initiated initiates an external base charge. The primer capsule construction provides a system wherein the primer charge reaches full velocity and shock by the time it reaches the small amount of base charge material and thus provides more efficient initiation.

41 Claims, 2 Drawing Sheets

DETONATOR PRIMER CAPSULE

TECHNICAL FIELD OF THE INVENTION

The invention relates to a detonator for explosives. Specifically, the invention relates to a primer capsule for incorporation into a detonator which is constructed such that a primer charge housed within the capsule is protected from sympathetic initiation and the output from the initiated primer charge is focused toward a small amount of base charge material contained within the capsule to provide efficient detonation of an external base charge.

BACKGROUND OF THE INVENTION

The present invention relates to explosive detonators, and more particularly, relates to explosive detonators wherein the primer charge is protected and the output of the primer charge is focused toward the base charge providing efficient initiation.

There are various detonator designs known in the art which basically fall into three categories. The first category of detonators are constructed such that the primer charge is located on top of the base charge and in intimate contact with the delay element. These designs do not provide for protection of the primer charge against sympathetic detonation, nor do those designs provide for focusing of the output from the primer charge for efficient detonation.

A second category of detonators known in the art are constructed such that the primer charge is protected in some manner, but includes a gap between the primer charge and the delay element, and thus, reliable initiation is not obtained. Further, these designs do not provide a means to focus the primer charge output toward the base charge and thus, are inefficient.

The third category of detonators known in the art are common among European manufacturers and are constructed such that the primer charge is located inside the delay element which is in intimate contact with the delay element core and protected against sympathetic detonation, but these designs do not focus the primer charge output toward the base charge and thus, are also inefficient.

None of the known detonator designs provide (1) primer charge protection against sympathetic initiation, (2) focusing of the primer charge output for efficient base charge initiation, and (3) intimate contact between the delay element and the primer charge for reliable initiation. The present invention provides a detonator which supplies protection of the primer charge, reliable initiation and efficient use of the primer charge and base charge materials.

SUMMARY OF THE INVENTION

The invention is directed to explosive detonators having a primer capsule contained therein. The primer capsule is comprised of a top and bottom. The capsule has a channel running therethrough wherein primer charge material and base charge material are contained. The capsule top, which is pointed in shape or frustrum shaped, contains primarily primer charge material in the channel. The top has an opening centrally located therein which is in communication with the channel containing primer charge and base charge material. The top provides protection for the primer charge against sympathetic detonation. The channel in the bottom which is in communication with the primer charge contained in the top contains primer charge and a base charge material. The base charge material is less sensitive than the primer charge and is preferably packed or pressed against the primer charge. The base charge material provides protection or insulation of the primer charge against sympathetic initiation from forces directed from the bottom of the primer capsule. The channel in the top and a portion of the channel in the bottom are preferably frustro-conical or frustro-trapezoidal shaped and thus focuses the output of the primer charge toward the base charge material to provide efficient detonation of an external base material. Also, the entire channel, in the top and bottom, can be frustro-conical or frustro-trapezoidal shaped.

DESCRIPTION OF THE INVENTION

Figure 1:
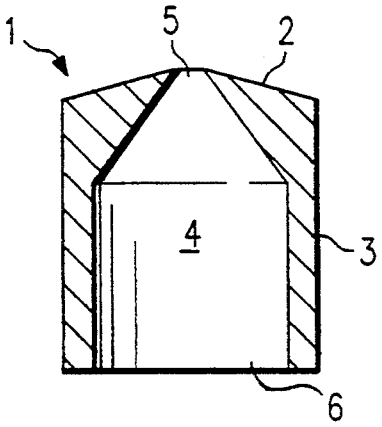
FIG. 1 is a cross-sectional view of the primer capsule of the present invention.
Figure 2:
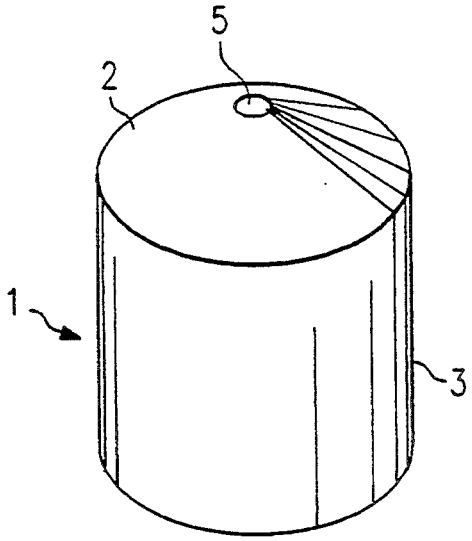
FIG. 2 is a perspective view of the primer capsule of the present invention.

The invention relates to electric and non-electric detonators for explosives. Specifically, the invention relates to detonators having a primer capsule inserted therein. The primer capsule of the present invention is illustrated in FIGS. 1 and 2. Referring to FIG. 1, primer capsule 1 is comprised of top 2 and bottom 3 having hollow channel 4 running therethrough. Top 2 has a small opening 5. As shown, channel 4 is in communication with opening 5 in top 2. Preferably, top 2 is pointed or frustrum-shaped and bottom 3 is tubular-shaped. As used herein, frustrum-shaped means shaped like the part of a cone or pyramid that is formed by cutting off the top by a plane parallel to the base. Preferably, channel 4 in top 2 and for a portion in bottom 3 is frustro-conical or frustro-trapezoidal-shaped. Preferably, the remaining portion of channel 4 in bottom 3 which is not frustro-conical or frustro-trapezoidal-shaped is tubular-shaped or cylindrical. Bottom 3 has a large opening 6 in communication with channel 4 as shown in FIG. 1. Large opening 6 is provided so that channel 4 can be in direct contact with an external base charge to be detonated. Preferably, the large opening is of the same width as channel 4 in bottom 3. FIG. 2 is a perspective view of primer capsule 1 shown in cross-section in FIG. 1.

The primer capsule of the present invention is preferably of a single uniform construction whereby the top and bottom are constructed of the same material or materials. Examples of materials which may be used to construct the primer capsule of the present invention include, but are not limited to, steel, lead, copper and copper alloys, aluminum, zinc, thermoplastic resins, graphite, or the like and mixtures thereof.

The dimensions of top 2, bottom 3, channel 4, opening 5, opening 6 and generally, primer capsule 1 is dependent upon the desired application and use of the primer capsule. Generally, the primer capsule of the present invention is of such shape and construction wherein it can be easily inserted into a detonator shell to provide intimate contact or communication between the core of a delay element in the detonator shell with a primer charge contained in the primer capsule through opening 5 in top 2 of capsule 1. However, it is also contemplated that primer capsule 1 of the present invention may be used alone, i.e., not inserted into a detonator.

Figure 3:
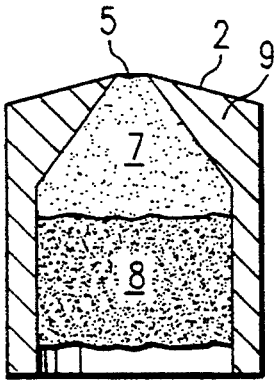
FIG. 3 is a cross-sectional view of the primer capsule of the present invention loaded with primer charge and a small charge of base material.

FIG. 3 illustrates a loaded primer capsule 1 of the present invention. Referring to FIG. 3, a primer charge material 7 is contained within the frustro-conical shaped portion of channel 4 in top 2 and bottom 3. A small amount of base charge material 8 is contained in channel 4 of bottom 3 and is pressed directly against primer charge 7 in channel 4.

The primer charge material contained inside the top of the primer capsule can be comprised of any primer charge material known in the art and includes, but is not limited to, lead azide, lead styphnate, diazodinitrophenol, and lead azide/lead styphnate mixtures. The specific primer charge material and the amount utilized depends upon the application, the desired rate of detonation, and the base charge to be initiated.

The small amount of base charge material 8 used in the present invention may be comprised of any known base charge material and includes, but is not limited to, such materials as PETN, RDX, HMX, or tetryl or mixtures thereof. The specific base charge material used and the amount used depends on the application, desired rate of detonation, and the base charge to be detonated.

Referring to FIG. 3, portion 9 of the walls of primer capsule 1 surrounding the frustro-conical portion of channel 4 containing primer charge 7 in top 2 and bottom 3 is thicker than the walls surrounding the tubular portion of channel 4 containing base charge material 8 in bottom 3. Portion 9 of the walls are of sufficient thickness to provide protection of primer charge 7 contained therein such that the primer charge material is not susceptible to sympathetic initiation from external sources. However, it is contemplated that other means of protection can be used instead of thicker walls. For example, portion 9 of the walls can be constructed of various materials which provide increased protection of the primer charge from sympathetic initiation.

In addition to the protective top, the primer charge is also protected from sympathetic detonation by the base charge material 8. The base charge material 8 is less sensitive than primer charge 7. Preferably, the base charge material is pressed against the primer charge such that the primer charge 7 is protected against sympathetic initiation from forces originating from the bottom of the primer capsule.

Channel 4 of primer capsule 1 is constructed such that upon initiation of the primer charge by a delay element through opening 5, the primer charge material reaches full velocity and shock and its output is focused upon base charge material 8 whereby efficient initiation of an external base charge is obtained. Note, while a portion of channel 4 may be frustro-conical shaped it may also be frustro-trapezoidal shaped.

While the drawings illustrate primer capsule 1 having a portion of channel 4 frustro-conical shaped, it should be understood that channel 4 may also be frustro-conical shaped or frustro-trapezoidal shaped throughout the entire length of primer capsule 1, i.e., from opening 5 in top 2 to the end of tubular bottom 3. In addition, though the present invention has been illustrated and described wherein the frustro-conical shaped portion of channel 4 contains only primer charge material, it is understood and contemplated that some primer charge material may be contained in the tubular shaped portion of channel 4 in bottom 3 and/or some of the base charge material may be contained within the frustro-conical shaped portion of channel 4 in top 2 or both.

The performance of the primer capsule of the present invention as opposed to a primer system wherein the primer charge is not protected nor is the output of the primer charge focused toward the base charge is illustrated in Table I below:

TABLE I

| Detonator Explosive Output | | |
|---|---|---|
| Primer System | Base Charge Weight | Grams of Sand Crushed |
| 120 mg. lead azide on top of base charge, no confinement and no focusing | 780 mg. PETN | 106 |
| 100 mg. lead azide plus 50 mg. PETN inside primer capsule | 600 mg. PETN | 104 |

From the data in Table I, the primer capsule of the present invention generated 0.160 grams crushed sand per milligram of PETN, while the unconfined system generated only 0.136 grams crushed sand per milligram of PETN. The primer capsule of the present invention generated this additional output using approximately 16 percent less lead azide.

The data in Table II below illustrates the higher level of shock protection provided by the primer capsule of the present invention. Detonators containing primer capsules of the present invention can therefore withstand much higher shock pressures in boreholes without sympathetic initiation.

TABLE II

| Resistance to Underwater Propagation | |
|---|---|
| Primer System | Pressure Tolerance |
| No confinement and no focusing | 8,000–9,000 psi |
| Primer capsule of the present invention | 14,000–16,000 psi |

Figure 4:
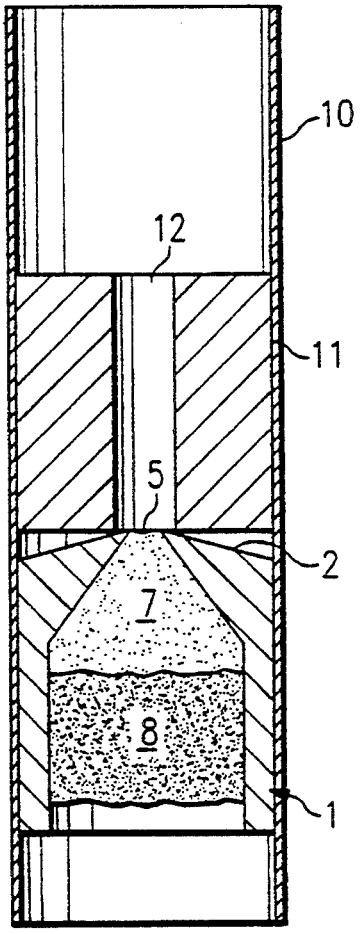
FIG. 4 is a cross-sectional view of the primer capsule of the present invention incorporated into a detonator shell.

FIG. 4 illustrates the primer capsule of the present invention inserted into detonator shell 10 containing delay element 11 having a core 12 centrally located therein. The detonator primer capsule is inserted into one end of the detonator shell such that opening 5 in top 2 containing primer charge material. 7 is in direct contact with core 12 of delay element 11 which is inserted in the other end of the detonator shell. As shown also in FIG. 3 and described above, in the primer capsule of the present invention, primer charge material 7 is in direct contact with base charge material 8.

Detonator shell 10 as illustrated and described above, may be comprised of various materials known in the art and includes, but is not limited to, steel, lead, aluminum, copper, thermoplastic resins, graphite, and the like and mixtures thereof. Preferably, the detonator shell is of tubular construction.

Figure 5:
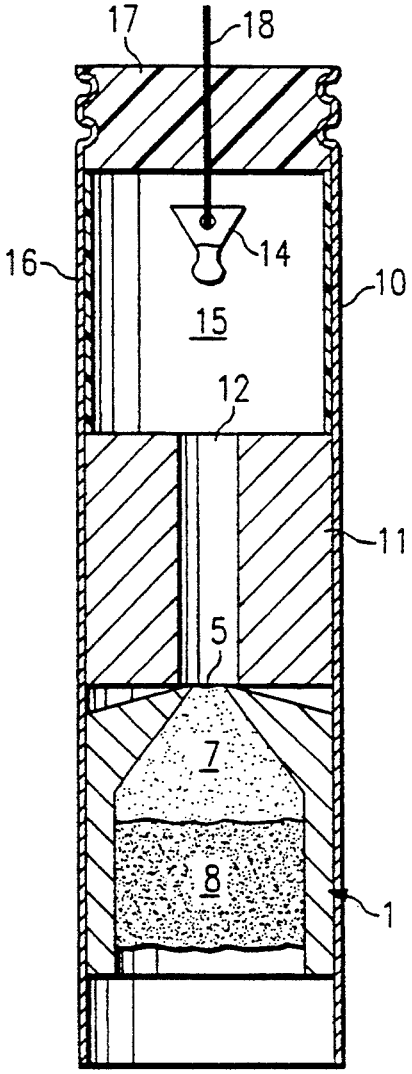
FIG. 5 is a cross-sectional view of the primer capsule of the present invention incorporated into an electric detonator.

Referring to FIG. 5, an electric detonator is shown utilizing the primer capsule of the present invention. As shown in FIG. 5, delay element 11 is inserted in one end of detonator shell 10 and primer capsule 1 is inserted into the other end of detonator 10 as shown and described in FIG. 4. An electric ignition source 14 is provided in air space 15. Air space 15 containing the ignition source 14 is provided with a plastic insulator sleeve 16. The ignition source 14 inside air space 15 is secured inside detonator shell 10 by sealing plug 17. Through sealing plug 17 run leg wires 18 which connect to ignition source 14 and to an external electrical source for ignition.

Figure 6:
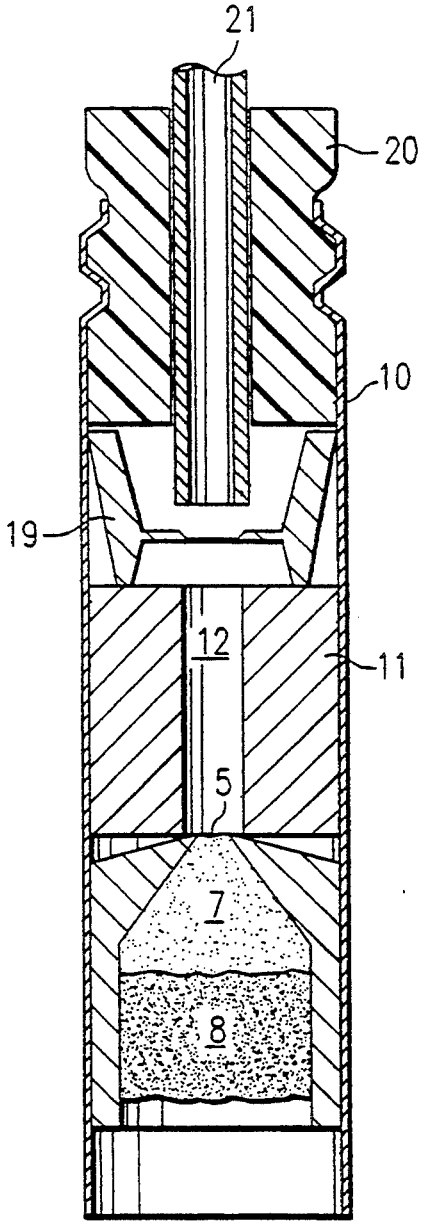
FIG. 6 is a cross-sectional view of the primer capsule of the present invention incorporated into a non-electric detonator.

Primer capsule 1 of the present invention can be used in a non-electric detonator as shown in FIG. 6. Delay element 11 and primer capsule 1 are inserted into detonation shell 10 as shown in FIGS. 4 and 5 and described above. As shown in FIG. 6, a static separator 19 is provided above delay element 11. On top of the static separator 19 is provided a closure bushing 20 having a channel running therethrough containing non-electric signal tube 21.

Figure 7:
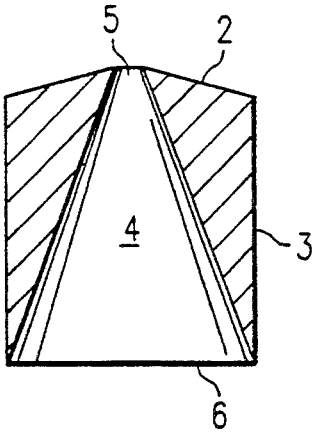
FIG. 7 is a cross-sectional view of the primer capsule of the present invention.

FIG. 7 illustrates one embodiment of the primer capsule of the present invention wherein channel 4 is frustro-conical or frustro-trapezoidal shaped for its entire length.

While the illustrative embodiments of the invention have been described with particularity, it will be understood that various other modifications will be apparent to and can be readily made by those skilled in the art without departing from the spirit and scope of the invention. Accordingly, it is not intended that the scope of claims appended hereto be limited to the examples and descriptions set forth herein but rather that the claims be construed as encompassing all the features of patentable novelty which reside in the present invention, including all features which would be treated as equivalents thereof by those skilled in the art to which the invention pertains.

What is claimed is:

1. A primer capsule for incorporation into a detonator comprising:

a pointed top having a frustro-conical or frustro-trapezoidal-shaped channel containing primer charge;

a tubular bottom having a channel containing primer charge and base charge material;

said top having a small opening in communication with the channel containing primer charge;

said bottom attached to said top whereby the channels in the top and bottom are in communication so that the primer charge in the top and primer charge in the bottom are in contact.

2. The primer capsule of claim 1 wherein the top and bottom are comprised of steel, lead, zinc, copper and copper alloys, aluminum, graphite, the thermoplastic resins, or mixtures or derivatives thereof.

3. The primer capsule of claim 1 wherein the primer charge is comprised of lead azide, lead styphnate, diazodinitrophenol, or mixtures thereof.

4. The primer capsule of claim 1 wherein the base charge material is comprised of PETN, tetryl, RDX, HMX or mixtures thereof.

5. The primer capsule of claim 1 wherein the top and bottom are comprised of a single uniform construction.

6. The primer capsule of claim 1 wherein a portion of the channel in the tubular bottom containing primer charge and base charge material is frustro-conical or frustro-trapezoidal-shaped.

7. The primer capsule of claim 1 wherein a portion of the channel in the tubular bottom containing primer charge is frustro-conical or frustro-trapezoidal-shaped and the portion of the channel containing base charge material is tubular shaped.

8. A primer capsule comprising:

a frustrum top and a tubular bottom, said top comprised of first and second ends and having a frustro-conical or frustro-trapezoidal-shaped channel containing primer charge, said first end of the top having a centrally located small opening in communication with the channel containing primer charge, said bottom having first and second ends and having a channel containing primer charge and base charge material, said first end of the bottom is attached to the second end of the top, such that the primer charge in the top and the primer charge in the bottom are in communication, said second end of the bottom having a large opening.

9. The primer capsule of claim 8 wherein the primer charge is comprised of lead azide, lead styphnate, diazodinitrophenol, or mixtures thereof.

10. The primer capsule of claim 8 wherein the base charge material is comprised of PETN, tetryl, RDX, or HMX or mixtures thereof.

11. The primer capsule of claim 8 wherein the top and bottom are comprised of steel, lead, zinc, copper and copper alloys, aluminum, graphite, thermoplastic resins, or mixtures or derivatives thereof.

12. The primer capsule of claim 8 comprised of a single uniform construction.

13. The primer capsule of claim 8 wherein the channel in the bottom containing primer charge is frustro-conical or frustro-trapezoidal shaped.

14. The primer capsule of claim 8 wherein a portion of the channel in the bottom containing base charge material is tubular shaped.

15. The primer capsule of claim 8 wherein a portion of the channel in the bottom containing base charge material is tubular shaped and a portion of the channel in the bottom containing primer charge is frustro-conical or frustro-trapezoidal shaped.

16. A primer capsule for incorporation into a detonator comprising:

a protective frustrum top having a frustro-conical-shaped channel containing primer charge and a tubular bottom having a channel containing primer charge and a small amount of base charge material, the frustrum top has first and second ends and has a small opening in the first end in communication with the channel containing primer charge, said tubular bottom has first and second ends and said first end of the bottom is connected to said second end of the top such that the channels of the top and bottom are in communication.

17. The primer capsule of claim 16 wherein the top and bottom are comprised of steel, lead, zinc, copper and copper alloys, aluminum, graphite, thermoplastic resins, or mixtures or derivatives thereof.

18. The primer capsule of claim 16 wherein the primer charge is comprised of lead azide, lead styphnate, diazodinitrophenol, or mixtures thereof.

19. The primer capsule of claim 16 wherein the small charge of base material is PETN, tetryl, RDX, HMX or mixtures thereof.

20. The primer capsule of claim 16 comprised of a single uniform construction.

21. The primer capsule of claim 16 wherein the channel in the bottom containing primer charge and a small amount of base charge material is frustro-conical or frustro-trapezoidal shaped.

22. The primer capsule of claim 16 wherein the channel containing primer charge and a small amount of base charge material in the tubular bottom is cylindrical.

23. The primer capsule of claim 16 wherein a portion of the channel in the bottom is frustro-conical or frustro-trapezoidal shaped and a portion is tubular shaped.

24. A detonator comprising:

a tubular shell having first and second ends containing a delay element and a primer capsule;

said delay element being positioned inside the first end of the shell and having a core centrally located therein;

said primer capsule being positioned inside the second end of the shell and comprised of a protective frustrum-shaped top and a tubular bottom;

said top having first and second ends with a frustro-conical or frustro-trapezoidal channel containing primer charge;

said top having an opening centrally located in the first end in communication with the channel containing primer charge;

said tubular bottom comprised of first and second ends and having a channel containing a primer charge and base charge material;

said first end of the bottom being connected to said second end of the top such that the primer charge in the top and the primer charge in the bottom are contacted;

said primer capsule is positioned inside the second end of the shell such that the opening centrally located in the first end of the top is in communication with the delay element core.

25. The detonator of claim 24 wherein the primer capsule top and bottom are comprised of steel, lead, zinc, copper and copper alloys, aluminum, graphite, thermoplastic resins, or mixtures or derivatives thereof.

26. The detonator of claim 24 wherein the primer charge is comprised of lead azide, lead styphnate, diazodinitrophenol, or mixtures thereof.

27. The detonator of claim 24 wherein the small charge of base material is PETN, tetryl, RDX, HMX or mixtures thereof.

28. The detonator of claim 24 wherein the primer capsule is comprised of a single uniform construction.

29. The detonator of claim 24 wherein the channel in the bottom of the primer capsule containing primer charge is frustro-conical or frustro-trapezoidal shaped.

30. The detonator of claim 24 wherein a portion of the channel in the bottom of the primer capsule is cylindrical.

31. The detonator of claim 24 wherein a portion of the channel in the: bottom of the primer capsule is frustro-conical or frustro-trapezoidal shaped and a portion of the channel in the bottom is cylindrical.

32. A primer capsule comprising:

a frustrum top having first and second ends and a tubular bottom having first and second ends;

said top having a frustro-conical-shaped channel containing primer charge;

said first end of the top having a small opening in communication with said channel containing primer charge;

said second end of the top having an opening the same width as the channel;

said bottom having a tubular-shaped channel containing primer charge and base charge material;

said bottom first and second ends having openings in communication with the channel of the same width as the channel containing primer charge and base charge material;

said bottom first end attached to said top second end such that the primer charge in the top and the primer charge in the bottom are contacted.

33. The primer capsule of claim 32 wherein the top and bottom are comprised of steel, lead, zinc, copper and copper alloys, aluminum, graphite, thermoplastic resins, or mixtures or derivatives thereof.

34. The primer capsule of claim 32 wherein the primer charge is comprised of lead azide, lead styphnate, diazodinitrophenol, or mixtures thereof.

35. The primer capsule of claim 32 wherein the base charge material is PETN, tetryl, RDX, HMX or mixtures thereof.

36. The primer capsule of claim 32 comprised of a single uniform construction.

37. A primer capsule comprised of:

a protective pointed top and a tubular bottom having a frustro-conical or frustro-trapezoidal shaped channel running therethrough;

said channel containing a primer charge and base charge material;

said top having a small opening in communication with the channel; and said bottom having a large opening in communication with the channel.

38. The primer capsule of claim 37 wherein the top and bottom are comprised of steel, lead, zinc, copper and copper alloys, aluminum, graphite, thermoplastic resins, or mixtures or derivatives thereof.

39. The primer capsule of claim 37 wherein the primer charge is comprised of lead azide, lead styphnate, diazodinitrophenol, or mixtures thereof.

40. The primer capsule of claim 37 wherein the base charge material is PETN, tetryl, RDX, HMX or mixtures thereof.

41. The primer capsule of claim 37 comprised of a single uniform construction.

* * * * *